US005522199A

United States Patent [19]

Pearce

[11] Patent Number: 5,522,199

[45] Date of Patent: Jun. 4, 1996

[54] MASKING TAPE TOOL GUIDE

[76] Inventor: Teddy D. Pearce, Rte. 2, Box 401M, Zebulon, N.C. 27597

[21] Appl. No.: 209,738

[22] Filed: Mar. 14, 1994

[51] Int. Cl.[6] ..... E04F 21/04; B32B 3/04

[52] U.S. Cl. ..... 52/749.1; 33/533; 428/58; 428/60

[58] Field of Search ..... 52/417, 749, 255; 428/57, 58, 60, 343, 352; 7/103, 105, 164, 170; 33/404, 481, 484, 485, 533, 645

[56] References Cited

U.S. PATENT DOCUMENTS

| | | | |
|---|---|---|---|
| 2,643,423 | 6/1953 | Brendel | 52/255 |
| 2,969,616 | 1/1961 | Gustafson | 52/255 |
| 3,307,313 | 3/1967 | Tatum | 52/255 |
| 3,606,714 | 9/1971 | Arnett | 52/255 |
| 3,972,762 | 8/1976 | Kawahara et al. | 428/60 |
| 4,722,153 | 2/1988 | Hardy | 52/255 |
| 4,965,119 | 10/1990 | Sancaktar | 428/60 |
| 5,311,717 | 5/1994 | Yount et al. | 52/417 |

*Primary Examiner*—Michael Safavi

[57] ABSTRACT

Disclosed is a new masking tape with tool guide for facilitating application of joint compound to wall joints and edges formed by drywall panels used to construct interior building walls. The masking tape with tool guide comprises an elongated strip of flexible tape having pressure-sensitive adhesive disposed on one side thereof whereby the paper strip may be adhered to a drywall panel adjacent a joint to be finished with joint compound. The tape is divided centrally longitudinally into a first half and a second half with release paper covering the pressure-sensitive adhesive of the first half and a straightedge member fixedly adhered to the second half of the paper strip by the pressure-sensitive adhesive. The straightedge member comprises an elongated strip of flexible solvent-resistant plastic having an integral longitudinal lip formed along one edge thereof. The lip defines a ledge adjacent the drywall joint wherealong a drywall knife tool may be drawn during application of joint compound whereby aiding in the uniform application thereof. An alternate embodiment of the masking tape with tool guide further includes a reinforcing glue bead applied between the second half of the paper strip and the plastic strip of the straightedge.

1 Claim, 4 Drawing Sheets

MASKING TAPE TOOL GUIDE

BACKGROUND OF THE INVENTION

1. Field of the Invention

The present invention relates to construction aids and more particularly pertains to masking tapes with tool guide which may be adapted for facilitating application of joint compound to wall joints and edges formed by drywall panels used to construct interior building walls.

2. Description of the Prior Art

The use of construction aids is known in the prior art. More specifically, construction aids heretofore devised and utilized for the purpose of applying joint compound to drywall joints during building construction are known to consist basically of familiar, expected and obvious structural configurations, notwithstanding the myriad of designs encompassed by the crowded prior art which have been developed for the fulfillment of countless objectives and requirements.

The present invention is directed to improving devices for facilitating application of joint compound to wall joints and edges formed by drywall panels used to construct interior building walls in a manner which is safe, secure, economical and aesthetically pleasing.

For example, U.S. Pat. No. 3,662,471 to Lynde discloses a measuring tape and chalk line holding tool, U.S. Pat. No. 4,942,670 to Brandt describes an adhesive template tape, and U.S. Pat. No. 4,949,462 to Spencer shows a drywall cutting guide.

The prior art also discloses a disposable layout tape as shown in U.S. Pat. No. 5,012,590 to Wagner et al., a drywall finishing tool adapter disclosed in U.S. Pat. No. 5,069,610 to Milburn, and a flexible reinforced polymeric material and a method of forming such a material of U.S. Pat. No. 5,098,768 to Holroyd et al.

While these devices fulfill their respective, particular objectives and requirements, the aforementioned patents do not disclose a masking tape with tool guide for facilitating application of joint compound to wall joints and edges formed by drywall panels used to construct interior building walls. Furthermore, none of the prior art patents teach or suggest a way of quickly and accurately applying joint compound in a straight line without the need to follow a guide line.

In this respect, the masking tape with tool guide according to the present invention substantially departs from the conventional concepts and designs of the prior art, and in so doing provides an apparatus primarily developed for the purpose of facilitating application of joint compound to wall joints and edges formed by drywall panels used to construct interior building walls.

Therefore, it can be appreciated that there exists a continuing need for new masking tape with tool guide which can be used for facilitating application of joint compound to wall joints and edges formed by drywall panels used to construct interior building walls. In this regard, the present invention substantially fulfills this need.

As illustrated by the background art, efforts are continuously being made in an attempt to develop devices for applying joint compound to drywall joints during building construction. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of construction aids now present in the prior art, the present invention provides a new construction aid construction wherein the same can be utilized for facilitating application of joint compound to wall joints and edges formed by drywall panels used to construct interior building walls. As such, the general purpose of the present invention, which will be described subsequently in greater detail, is to provide a new masking tape with tool guide apparatus and method which has all the advantages of the prior art construction aids and none of the disadvantages.

The invention is defined by the appended claims with the specific embodiment shown in the attached drawings. For the purpose of summarizing the invention, the invention may be incorporated into a new masking tape with tool guide for facilitating application of joint compound to wall joints and edges formed by drywall panels used to construct interior building walls. The masking tape with tool guide comprises an elongated strip of flexible solvent-resistant paper having pressure-sensitive adhesive disposed on one side thereof whereby the paper strip may be adhered to a drywall panel adjacent a joint to be finished with joint compound. The strip is divided centrally longitudinally into a first half and a second half. Release paper is disposed over the pressure-sensitive adhesive of the first half, the release paper being releasably adhered to the pressure-sensitive adhesive whereby preventing unwanted adhesion of the paper strip and protecting the adhesive from dirt prior to application to a drywall panel. A straightedge member is disposed over the pressure-sensitive adhesive of the second half, being fixedly adhered to the second half of the paper strip by the pressure-sensitive adhesive. The straightedge member comprises an elongated strip of flexible solvent-resistant plastic having an integral longitudinal lip formed along one edge thereof. The lip extends outwardly, over a longitudinal edge of the paper strip, normal the plane of the plastic strip and opposite the pressure-sensitive adhesive. The lip defines a ledge adjacent the drywall joint wherealong a drywall knife tool may be drawn during application of joint compound whereby aiding in the uniform application thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a masking tape with tool guide for facilitating application of joint compound to wall joints and edges formed by drywall panels used to construct interior building walls.

It is another object of the present invention to provide a new masking tape with tool guide which may be easily and efficiently manufactured and marketed.

It is a further object of the present invention to provide a new masking tape with tool guide which is of a durable and reliable construction.

An even further object of the present invention is to provide a new masking tape with tool guide which is susceptible of a low cost of manufacture with regard to both materials and labor, and which accordingly is then susceptible of low prices of sale to the consuming public, thereby making such masking tapes with tool guide economically available to the buying public.

Still yet another object of the present invention is to provide a new masking tape with tool guide which provides in the apparatuses and methods of the prior art some of the advantages thereof, while simultaneously overcoming some of the disadvantages normally associated therewith.

Still yet another object of the present invention is to provide a new masking tape with tool guide that permits the user to quickly and accurately apply joint compound in a straight line without the need to follow a guide line.

Yet another object of the present invention is to provide a new masking tape with tool guide that allows amateur drywall finishers to obtain professional results.

Even still another object of the present invention is to provide a new masking tape with tool guide that is effective when working in areas having panels which intersect at an acute angle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
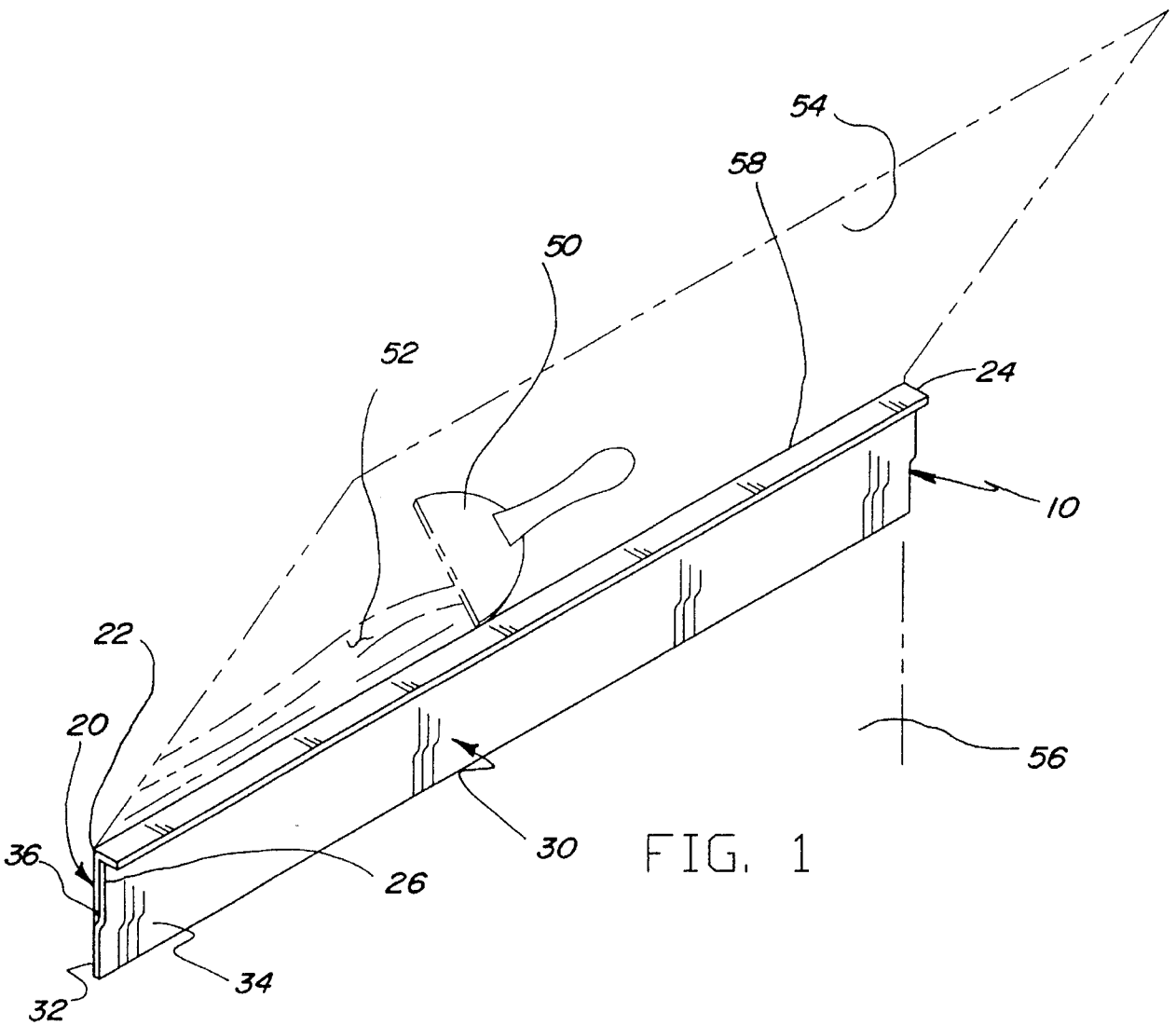
FIG. 1 is a perspective view of the new masking tape with tool guide showing its manner of use.
Figure 2:
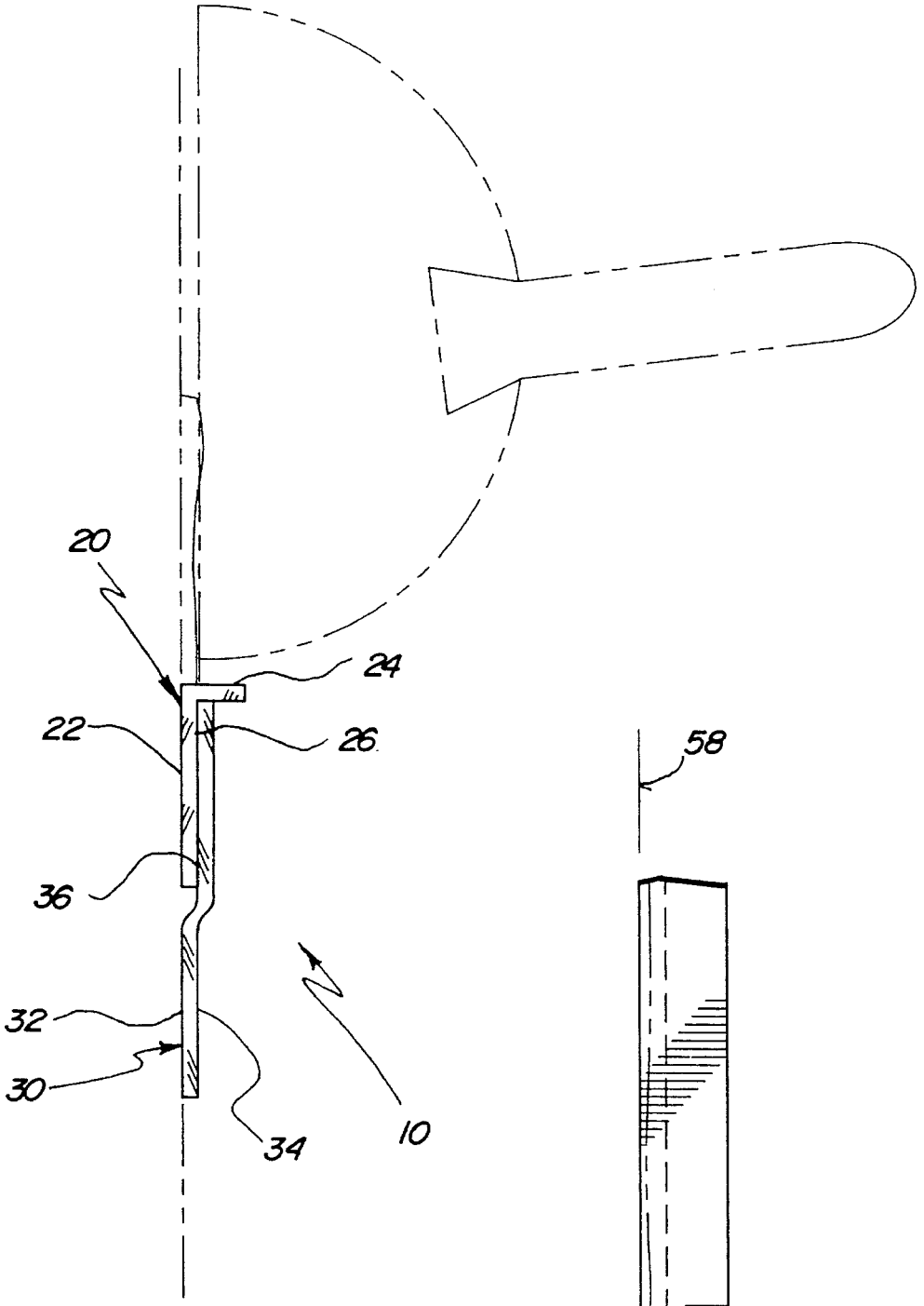
FIG. 2 is a side elevational view of the invention of FIG. 1 also showing its manner of use.
Figure 3:
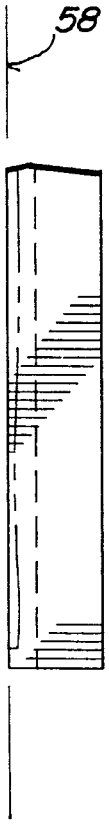
FIG. 3 is a front elevational view of the present invention.
Figure 4:
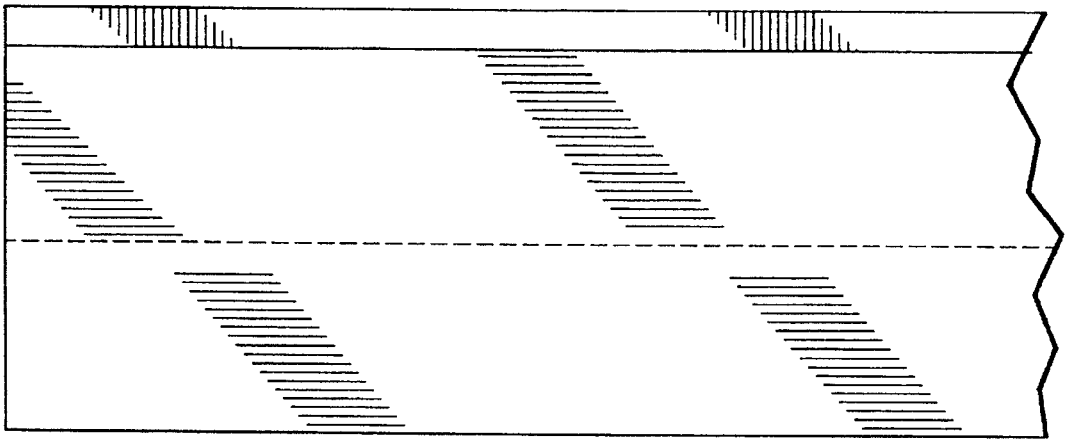
FIG. 4 is a partial front elevational view of the invention of FIG. 1.

With reference now to the drawings, and in particular to FIG. 1 thereof, a new masking tape with tool guide embodying the principles and concepts of the present invention and generally designated by the reference numeral 10 will be described.

From an overview standpoint, the masking tape with tool guide is adapted for use for facilitating application of joint compound to wall joints and edges formed by drywall panels used to construct interior building walls. See FIG. 1.

With reference now to FIGS. 1–7 and more specifically, it will be noted that a new masking tape with tool guide is shown. The masking tape with tool guide 10 comprises an elongated strip 30 of flexible solvent-resistant paper having pressure-sensitive adhesive 32 disposed on one side thereof whereby the paper strip 30 may be adhered to a drywall panel 56 adjacent a joint to be finished 58 with joint compound 52. The strip 30 is divided centrally longitudinally into a first half 34 and a second half 36.

Release paper 46 is disposed over the pressure-sensitive adhesive 32 of the first half 34, the release paper 46 being releasably adhered to the pressure-sensitive adhesive 32 whereby preventing unwanted adhesion of the paper strip 30 and protecting the adhesive 32 from dirt prior to application to a drywall panel 56. A straightedge member 20 is disposed over the pressure-sensitive adhesive 32 of the second half 36, being fixedly adhered to the second half 36 of the paper strip 30 by the pressure-sensitive adhesive 32.

The straightedge member 20 comprises an elongated strip 22 of flexible solvent-resistant plastic having an integral longitudinal lip 24 formed along one edge thereof. The lip 24 extends outwardly, over a longitudinal edge of the paper strip 30, normal the plane of the plastic strip 22 and adjacent the pressure-sensitive adhesive 32. The lip 24 defines a ledge adjacent the drywall joint 58 wherealong a drywall knife tool 50 may be drawn during application of joint compound 52 whereby aiding in the uniform application thereof.

Figure 5:
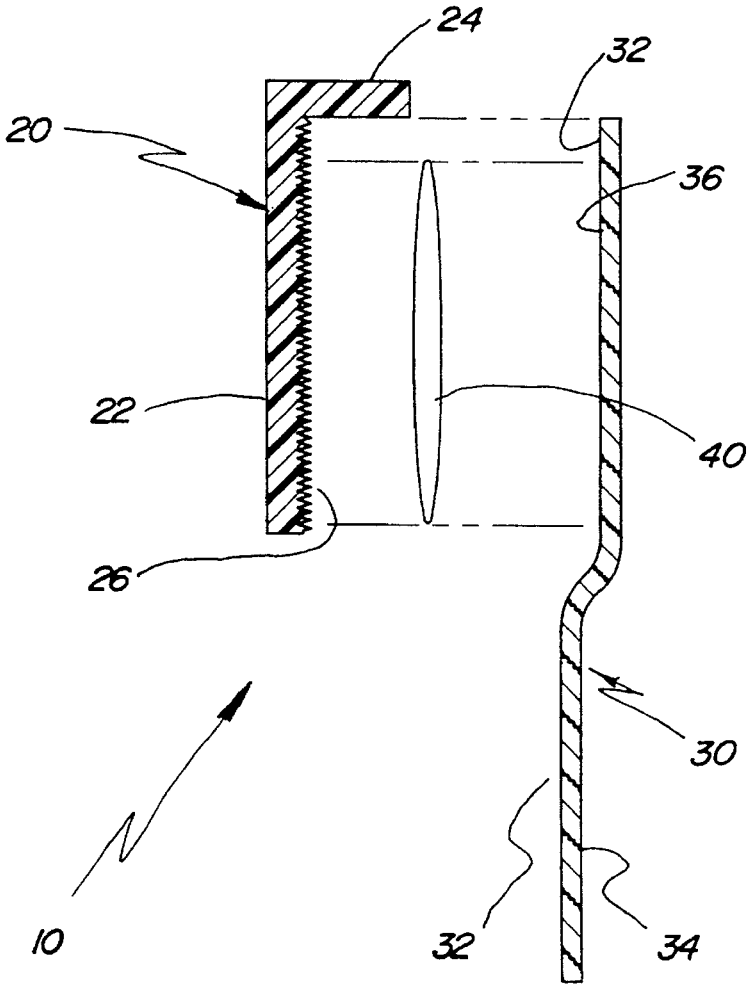
FIG. 5 is a sectional exploded view of an alternate embodiment of the invention showing its component parts.
Figure 7:
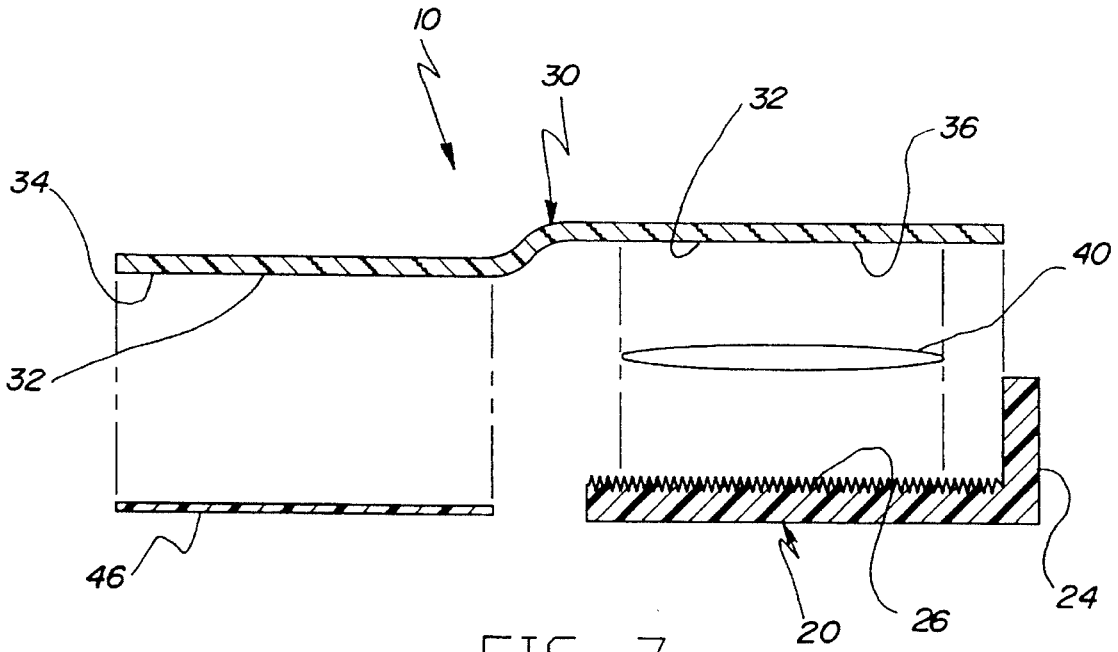
FIG. 7 is a sectional exploded view of the invention of FIG. 6 taken along the line 7—7 and showing the added release paper.
Figure 6:
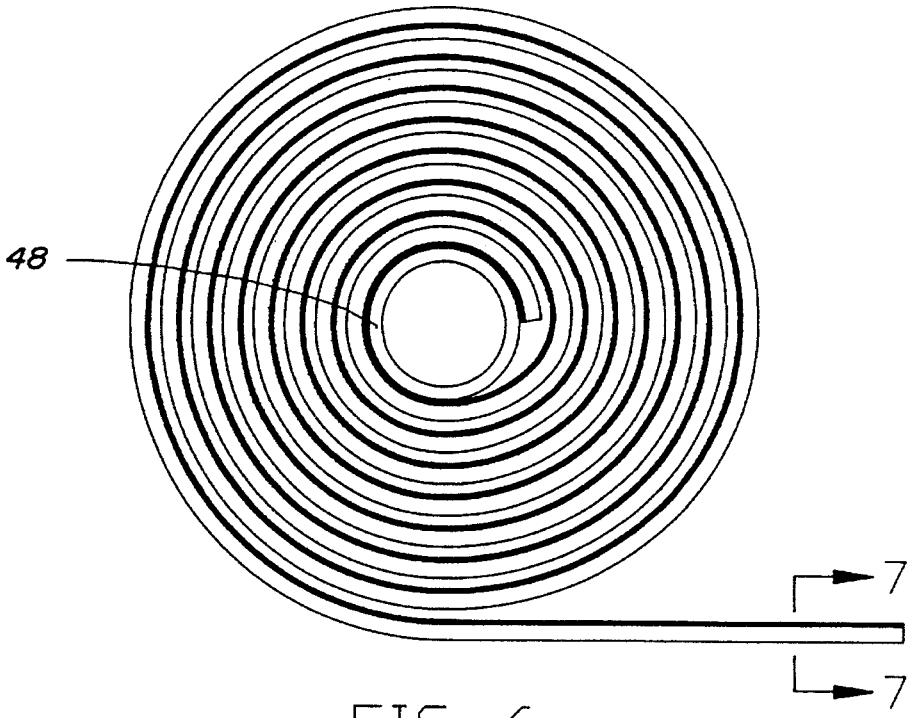
FIG. 6 is a top plan view of the new masking tape with tool guide illustrating the invention coiled for storage and display.

An alternate embodiment of the masking tape with tool guide 10, shown in FIGS. 5, 6, and 7, further includes a reinforcing glue bead 40 applied between the second half 36 of the paper strip 30 and the plastic strip 22 of the straightedge 20. A plurality of longitudinal grooves 26 are formed on the plastic strip 22 to increase the surface area for glue adhesion whereby the glue bond between the second half 36 of the paper strip and the straightedge 20 is improved. FIG. 6 also illustrates a method of unit packaging for distribution wherein the masking tape with tool guide 10 is wound on a core 48 to form a compact roll.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new masking tape with tool guide for facilitating application of joint compound to wall joints and edges formed by drywall panels used to construct interior building walls, the masking tape with tool guide comprising:

an elongated paper strip of flexible solvent-resistant material having pressure-sensitive adhesive disposed on a portion of one side thereof whereby said paper strip may be adhered to a drywall panel adjacent a joint to be finished with joint compound, the strip being divided centrally longitudinally into a first half and a second half with said pressure-sensitive adhesive disposed on one side extending over each of the first and second halves;

release paper disposed over the pressure-sensitive adhesive on the first half, the release paper being releasably adhered to the pressure-sensitive adhesive whereby preventing unwanted adhesion of said paper strip and protecting the adhesive from dirt prior to application to a drywall panel;

a straightedge member disposed over the pressure-sensitive adhesive on the second half, the straightedge member being fixedly adhered to the pressure-sensitive adhesive, the straightedge member comprising an elongated strip of flexible solvent-resistant plastic having an integral longitudinal lip formed along one edge thereof, the lip extending outwardly over a longitudinal edge of the paper strip normal the plane of the elongated plastic strip and adjacent to the pressure-sensitive adhesive to define a ledge adjacent a drywall joint wherealong a drywall knife tool may be drawn during application of joint compound whereby aiding in the uniform application thereof, the plastic strip of the straightedge including a plurality of longitudinal grooves formed thereon; and a reinforcing glue bead applied between the second half of the paper strip and the plastic strip of the straight edge.

* * * * *